US005333651A

United States Patent [19]

Riezler

[11] Patent Number: 5,333,651

[45] Date of Patent: Aug. 2, 1994

[54] PNEUMATIC WEFT GUIDE IN AN AUXILIARY REED

[75] Inventor: Rudolf Riezler, Nonnenhorn, Fed. Rep. of Germany

[73] Assignee: Lindauer Dornier GmbH, Lindau, Fed. Rep. of Germany

[21] Appl. No.: 52,131

[22] Filed: Apr. 22, 1993

[30] Foreign Application Priority Data

Apr. 25, 1992 [DE] Fed. Rep. of Germany ..... 4213754

[51] Int. Cl.[5] ..... D03D 47/48

[52] U.S. Cl. ..... 139/435.5; 139/370.2; 139/194

[58] Field of Search ..... 139/370.02, 302, 195, 139/192, 433, 430, 194, 435.5

[56] References Cited

U.S. PATENT DOCUMENTS

| | | | |
|---|---|---|---|
| 4,520,850 | 6/1985 | Cramer et al. | 139/302 X |
| 4,601,313 | 7/1986 | Aarts | 139/194 |
| 5,224,521 | 7/1993 | De Jager | 139/192 X |
| 5,226,458 | 7/1993 | Bamelis | 139/194 |

*Primary Examiner*—Andrew M. Falik

*Attorney, Agent, or Firm*—W. G. Fasse; W. F. Fasse

[57] ABSTRACT

The binding of free weft thread ends at the exit of the weft thread insertion channel in an air weaving loom, into the fabric edge, is to be avoided. For this purpose it is necessary to straighten out the turbulent weft thread ends. The straightening is accomplished by a blowing nozzle that directs its air stream onto the free weft thread ends in a direction substantially defined by the fabric withdrawal. The auxiliary nozzle is arranged in an auxiliary reed section used for forming an auxiliary selvage. Such a blowing nozzle may be combined with a nozzle for stretching the weft thread end.

8 Claims, 1 Drawing Sheet

PNEUMATIC WEFT GUIDE IN AN AUXILIARY REED

FIELD OF THE INVENTION

The invention relates to air nozzle looms in which a turbulent weft thread end at the exit end of the shed is pneumatically guided through that part of an air insertion channel where into an auxiliary selvage is formed.

BACKGROUND INFORMATION

It is known to bind the protruding ends of weft threads into an auxiliary selvage with the aid of auxiliary warp threads. The auxiliary selvage is separated from the fabric itself. The formation of the auxiliary selvage takes place simultaneously with the beat up of the weft threads. The weft threads inserted into the loom shed have such a length, that the leading end of the weft thread at the exit end of the weft thread insertion channel passes a weft thread monitor, which is an integral part of the beat up reed. The weft thread monitor generates a signal that informs the central loom control regarding the proper weft thread insertion into the loom shed. The continued weaving operation is controlled by these weft thread monitor signals. As long as these signals remain uninterrupted, a proper weaving operation is assured.

Due to technological requirements the weft thread ends protrude from the outer edge of the auxiliary selvage. These protruding ends of the weft threads are subject to pneumatic turbulences due to the pneumatic of the weft thread into the weft channel insertion in an air loom. These turbulences of the weft thread ends cause a problem in that the weft thread ends of weft threads that have already been beat up, can be bound into the fabric during the next beat-up or shed change. Such binding of protruding weft thread ends into the fabric is unintended and results in fabric faults, which in turn reduce the fabric quality, even if later on efforts are made to pull the bound-in weft thread ends out of the fabric.

It is also known to center the weft thread ends by exposing these ends to a suction flow generated by a suction nozzle directed into the area of the turbulence. The suction nozzle thus tries to suck off the air causing the turbulence. Such a suction operation has not yielded a satisfactory result, because, on the one hand, the suction nozzle cannot be brought close enough to the free weft thread ends due to the limited available space at the exit end of the weft thread insertion channel and because on the other hand a relatively large volume of air must be sucked in by the suction nozzle. Additionally, such a suction nozzle involves a substantial structural effort and expense. Thus, economic and technical reasons militate against controlling the turbulence problem at the exit of the weft thread insertion channel by means of suction nozzles.

Another problem caused by fluttering weft thread ends resides in the fact that these ends cause disturbances in the automatic sequence of the weaving operation. For example, such turbulent weft thread ends can lead to the interruption of the light barriers that form part of the above mentioned weft thread monitors, so that a signal will be generated indicating that a weft thread was not properly inserted, which leads to a substantial interruption, especially in looms comprising a device for an automatic weft thread break removal. It is possible, that an automatic weft thread removal due to a break in the weft thread may be interrupted by a fluttering weft thread end, which must be avoided.

OBJECTS OF THE INVENTION

In view of the foregoing it is the aim of the invention to achieve the following objects singly or in combination:

- to effectively guide weft thread ends at the exit of an air insertion channel for the weft thread in an air loom to thereby avoid the above outlined problems;
- to provide an efficient, yet cost-effective device for the directing of weft thread ends;
- to prevent the binding of free weft thread ends into the fabric proper and to make sure that these weft thread ends are properly bound into an auxiliary selvage; and
- to properly guide weft thread ends for binding these weft thread ends in an auxiliary selvage.

SUMMARY OF THE INVENTION

The above objects have been achieved according to the invention by the combination of the following features. An auxiliary reed is located at the exit end of the weft thread insertion channel for forming an auxiliary selvage. Downstream of the auxiliary selvage, as viewed in the weft thread insertion direction, there is arranged an air channel leading into a blow nozzle, which is directed with its nozzle exit opening substantially in the fabric withdrawal direction, so that protruding weft thread ends will be blown and straightened out in the fabric withdrawal direction.

In a preferred embodiment of the invention the air channel with its blowing nozzle for directing the weft thread ends in the fabric withdrawal direction is combined with a further air nozzle for stretching the weft thread end. Each of these nozzles, the directing nozzle and the stretching nozzle, have their own air supply channels for blowing air in the respective directions.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
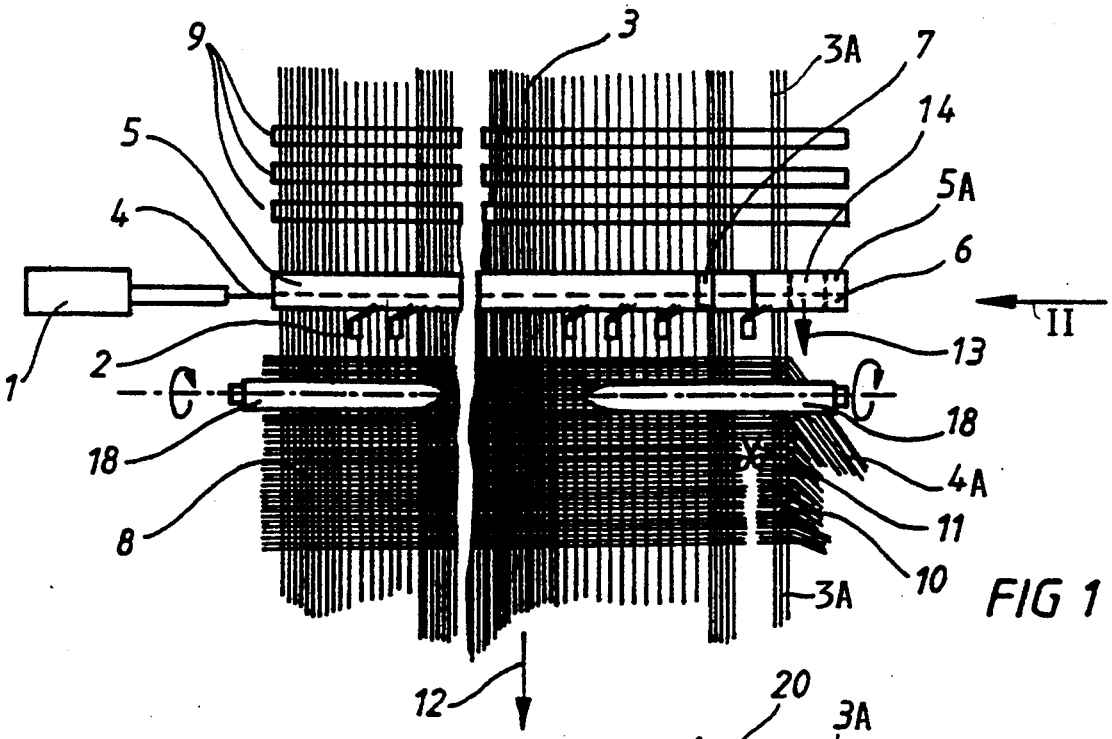
FIG. 1 is a schematic top plan view onto the fabric formation of an air nozzle loom.

FIG. 1 shows the weft thread insertion nozzle 1 and the relay nozzles 2 for transporting a weft thread 4 through a weft thread insertion channel 6 of the weaving reed 5. An auxiliary reed 5A section is positioned at the exit end of the weft thread insertion channel 6. This channel also passes through the auxiliary reed 5A. The shed is formed by the warp threads 3 including auxiliary warp threads 3A for forming an auxiliary selvage 10.

A weft thread monitor 7 monitors in a conventional manner the passage of a weft thread 4 through the channel 6 to thereby provide a loom control signal for controlling the continuous operation of the loom. The monitor 7 is arranged close to the exit end of the weaving reed 5. When a weft thread 4 is properly inserted, the loom control causes the next beat up motion unless a signal is provided indicating a faulty weft thread insertion. As long as the insertion is without fault, the weft threads are beat-up by the reed motion against the fabric 8 and the shed is closed by the operation of the heald shafts 9 and opened again for the next weft thread insertion. Simultaneously with the formation of the fabric, the auxiliary selvage 10 is formed along the right hand side of the fabric edge. Following the beat-up motion, the auxiliary selvage 10 is connected to the fabric by the weft threads 4 until scissors 11 are activated to cut off the auxiliary selvage 10 from the fabric. The scissors 11 are located where it is technologically most convenient. Similarly, the timing of the operation of the scissors is controlled with regard to convenience within the weaving operation sequence.

The free ends 4A of the weft threads 4 at the right hand side or exit end of the insertion channel 6 have a tendency to be exposed to turbulent air flows due to the air insertion operation and due to the beat up motions and other loom motions. Thus, these ends 4A have a tendency to flutter and can be bound into the regular fabric. The invention aims at solving this problem. This is accomplished by blowing the ends 4A substantially in the direction of the arrow 12 indicating the fabric withdrawal direction. For this purpose an air stream 13 is ejected from an auxiliary blowing nozzle 14 positioned in the auxiliary reed 5A which forms part of the loom reed 5. The auxiliary blowing nozzle 14 receives its blowing air from an air channel 15 shown in FIGS. 2 and 3.

Figure 2:
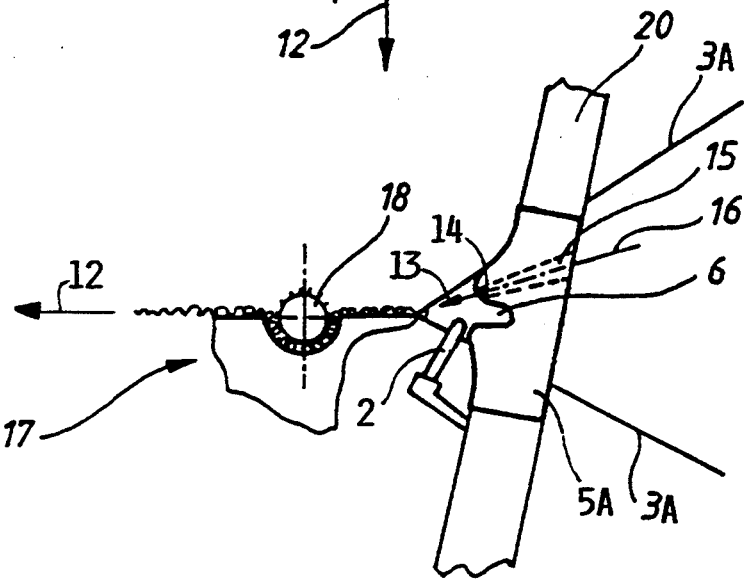
FIG. 2 is a view in the direction of the arrow II in FIG. 1.

FIG. 2 illustrates an orientation of the direction of the blowing air at an acute angle enclosed between the line 16 and the plane defined by the fabric withdrawal in the direction 12.

Figure 3:
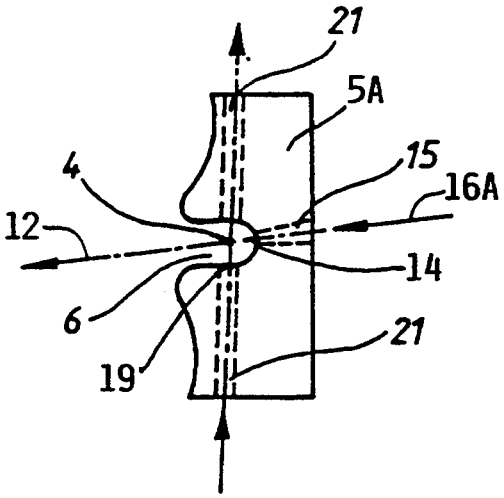
FIG. 3 shows an embodiment in which an auxiliary air blowing nozzle for straightening out a weft thread end is combined with a weft stretching nozzle in an auxiliary reed.

FIG. 3 shows a modified embodiment in which the air channel 15 for the nozzle 14 is oriented substantially in the direction of the fabric withdrawal as indicated by the two arrows 12 and 16A.

By exposing the weft thread ends 4A to an air stream 13 as just described, the weft thread ends are directly seized following the weft thread insertion by a spreader rod 18 of a spreader mechanism 17. The spreader rod 18 rotates clockwise as viewed in the direction of the arrow II in FIG. 1. Thus, the danger that the weft thread ends 4A are bound into the fabric 8 is removed and these weft thread ends can no longer have an adverse influence on the fabric quality nor on the weaving operation.

FIG. 3 further shows a combination of the nozzle 14 with a blowing nozzle or a suction nozzle 19 for stretching the weft thread 4 in the air channel portion 6 of the reed S and of the auxiliary reed 5A. The air for the nozzle 19 is provided by air channels 21 which have a configuration corresponding to the auxiliary reed 5A which carries reed heddles or lamellae 20 as is conventional. Thus, the part with the nozzle 19 and with channels 21 is fully integrated into the auxiliary reed 5A. Further, the contours of the part with the nozzles 19 and 14 conform to the contour of the surface of the insertion channel 6 and of the auxiliary reed 5A.

Referring further to FIG. 3, the direction of the air stream through the air supply channel 21 and the direction of the air stream indicated by the arrow 16A intersect each other, preferably substantially centrally, in the weft thread insertion channel 6 of the auxiliary reed section 5A. The air blow impulses through the channel 21 and through the channel 15 do not take place simultaneously. These air blows are provided by a pressurized air source not shown, since it is of conventional construction.

The invention achieves the following advantages singly or in combination. The binding of the free weft threads ends 4A into the fabric 8 is positively prevented and the proper formation of the auxiliary selvage 10 is assured. An expensive and ineffecient suction device for controlling the turbulent weft thread ends 4A is avoided with the added advantage that the required air volume is substantially reduced. Any interruption of an automatically proceeding removal of a faulty weft thread, for example when the weft thread is torn, is also avoided.

Although the invention has been described with reference to specific example embodiments, it will be appreciated that it is intended to cover all modifications and equivalents within the scope of the appended claims.

What I claim is:

1. An apparatus for pneumatically guiding a turbulent weft thread end in an air nozzle loom, comprising a reed and a weft air insertion channel passing through said reed, an auxiliary reed section (5A) for forming an auxiliary selvage, said auxiliary reed section being positioned to form an exit end of said weft air insertion channel, an auxiliary air blowing nozzle cooperating with said auxiliary reed section downstream of said auxiliary selvage as viewed in a weft threaded insertion direction, said auxiliary blowing nozzle having an air supply channel, said auxiliary blowing nozzle having a nozzle exit opening for blowing an air stream onto weft thread ends substantially in a fabric withdrawal direction, said nozzle exit opening having a contour corresponding to a contour of said auxiliary reed section.

2. The apparatus of claim 1, wherein said auxiliary air blowing nozzle with its air supply channel is positioned directly within a contour of said exit end of said weft air insertion channel in said auxiliary reed section.

3. The apparatus of claim 1, wherein said nozzle exit opening of said auxiliary blowing nozzle is positioned in a plane defined by fabric being withdrawn in said withdrawing direction.

4. The apparatus of claim 1, wherein said nozzle exit opening of said auxiliary blowing nozzle is directed at an acute angle relative to the plane defined by fabric being withdrawn in said withdrawing direction.

5. The apparatus of claim 1, further comprising a weft thread stretching nozzle in combination with said auxiliary blowing nozzle, said stretching nozzle positioned in said auxiliary reed section.

6. The apparatus of claim 5, further comprising separate air supply channels (15, 21) in said auxiliary reed section for supplying air to said stretching nozzle and to said auxiliary blowing nozzle.

7. An apparatus for pneumatically guiding a turbulent weft thread end in an air nozzle loom, comprising a reed and a weft air insertion channel passing through said reed, an auxiliary reed section (5A) for forming an auxiliary selvage, said auxiliary reed section being positioned to form an exit end of said weft air insertion channel, an auxiliary air blowing nozzle cooperating with said auxiliary reed section downstream of said auxiliary selvage as viewed in a weft thread insertion direction, said auxiliary blowing nozzle having an air supply channel, said auxiliary blowing nozzle having a nozzle exit opening for blowing an air stream onto weft thread ends substantially in a fabric withdrawal direction, wherein said auxiliary air blowing nozzle with its air supply channel is positioned directly within a contour of said exit end of said weft air insertion channel in said auxiliary reed section.

8. An apparatus for pneumatically guiding a turbulent weft thread end in an air nozzle loom, comprising a reed and a weft air insertion channel passing through said reed, an auxiliary reed section (5A) for forming an auxiliary selvage, said auxiliary reed section being positioned to form an exit end of said weft air insertion channel, an auxiliary air blowing nozzle cooperating with said auxiliary reed section downstream of said auxiliary selvage as viewed in a weft thread insertion direction, said auxiliary blowing nozzle having an air supply channel, said auxiliary blowing nozzle having a nozzle exit opening for blowing an air stream onto weft thread ends substantially in a fabric withdrawal direction, further comprising a weft thread stretching nozzle in combination with said auxiliary blowing nozzle positioned directly in said auxiliary reed section, and separate supply channels (15, 21) in said auxiliary reed section for supplying air to said stretching nozzle and to said auxiliary blowing nozzle.

* * * * *

UNITED STATES PATENT AND TRADEMARK OFFICE

CERTIFICATE OF CORRECTION

PATENT NO. : 5,333,651

DATED : August 2, 1994

INVENTOR(S) : Rudolf Riezler

It is certified that error appears in the above-indentified patent and that said Letters Patent is hereby corrected as shown below:

column 1, line 31, after "pneumatic" insert --insertion--;
line 32, delete "insertion".

Signed and Sealed this

Twenty-seventh Day of September, 1994

*Attest:*

*Attesting Officer*

Bruce Lehman

BRUCE LEHMAN

*Commissioner of Patents and Trademarks*